US007163471B2

(12) United States Patent
Kim et al.

(10) Patent No.: US 7,163,471 B2
(45) Date of Patent: Jan. 16, 2007

(54) GOLF BALLS HAVING SOUND-ALTERED LAYERS AND METHODS FOR MAKING THEM

(75) Inventors: Hyun Jin Kim, Carlsbad, CA (US); Dean A. Snell, Oceanside, CA (US); Eric Loper, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 10/339,995

(22) Filed: Jan. 10, 2003

(65) Prior Publication Data

US 2004/0138007 A1 Jul. 15, 2004

(51) Int. Cl.
*A63B 37/12* (2006.01)

(52) U.S. Cl. ..... 473/378

(58) Field of Classification Search ..... 473/378, 473/351

See application file for complete search history.

(56) References Cited

U.S. PATENT DOCUMENTS

| | | | | |
|---|---|---|---|---|
| 711,529 | A | 10/1902 | Richards | |
| 1,369,868 | A | 3/1921 | Worthington | |
| 3,211,700 | A | 10/1965 | Weisfeld | 260/75 |
| 3,230,199 | A | 1/1966 | Muhlhausen et al. | 260/75 |
| 3,238,156 | A * | 3/1966 | Kohrn | 473/371 |
| 3,671,477 | A | 6/1972 | Nesbitt | 260/23.5 A |
| 3,883,145 | A | 5/1975 | Cox et al. | 273/218 |
| 4,083,901 | A | 4/1978 | Schonfeld et al. | 264/25 |
| 4,085,165 | A | 4/1978 | Odaka et al. | 260/859 R |
| 4,085,937 | A | 4/1978 | Schenk | 273/218 |
| 4,123,061 | A | 10/1978 | Dusbiber | 273/220 |
| 4,244,855 | A | 1/1981 | Cox et al. | 260/33.6 |
| 4,255,552 | A | 3/1981 | Schollenberger et al. | 528/50 |
| 4,321,183 | A | 3/1982 | Cox et al. | 524/423 |
| 4,335,231 | A | 6/1982 | Singh | 528/49 |
| 4,483,537 | A | 11/1984 | Hanada et al. | 273/220 |
| 4,679,794 | A | 7/1987 | Yamada et al. | 273/235 R |
| 4,836,552 | A * | 6/1989 | Puckett et al. | 473/372 |
| 4,863,167 | A | 9/1989 | Matsuki et al. | 273/62 |
| 4,971,329 | A | 11/1990 | Llort et al. | 273/218 |
| 4,991,851 | A | 2/1991 | Melesio | 273/213 |
| 5,123,659 | A | 6/1992 | Williams | 273/60 B |
| 5,130,384 | A | 7/1992 | Damewood et al. | 525/455 |
| 5,210,127 | A | 5/1993 | Werner et al. | 524/589 |
| 5,312,857 | A | 5/1994 | Sullivan | 524/400 |
| 5,674,921 | A | 10/1997 | Regula et al. | 522/97 |
| 5,692,974 | A | 12/1997 | Wu et al. | 473/377 |
| 5,759,676 | A | 6/1998 | Cavallaro et al. | 428/215 |
| 5,779,561 | A | 7/1998 | Sullivan et al. | 473/373 |
| 5,810,678 | A | 9/1998 | Cavallaro et al. | 473/373 |
| 5,824,746 | A | 10/1998 | Harris et al. | 525/196 |
| 5,947,842 | A | 9/1999 | Cavallaro et al. | 473/373 |
| 5,971,870 | A | 10/1999 | Sullivan et al. | 473/373 |
| 6,008,312 | A | 12/1999 | Shirasaka | 528/75 |
| 6,012,991 | A | 1/2000 | Kim et al. | 473/374 |
| 6,117,025 | A | 9/2000 | Sullivan | 473/373 |
| 6,123,629 | A | 9/2000 | Yamaguchi et al. | 473/372 |
| 6,123,929 | A | 9/2000 | Gonzenbach et al. | 424/59 |
| 6,132,324 | A | 10/2000 | Hebert et al. | 473/378 |
| 6,149,536 | A | 11/2000 | Sullivan et al. | 473/376 |
| 6,152,835 | A | 11/2000 | Sullivan et al. | 473/373 |
| 6,172,161 | B1 | 1/2001 | Bissonnette et al. | 525/193 |
| 6,183,382 | B1 | 2/2001 | Kim et al. | 473/374 |
| 6,193,617 | B1 * | 2/2001 | Mertens | 473/351 |
| 6,213,892 | B1 | 4/2001 | Felker et al. | 473/370 |
| 6,237,302 | B1 | 5/2001 | Fricke | 52/720.1 |
| 6,251,031 | B1 | 6/2001 | Hayashi et al. | 473/376 |
| 6,258,310 | B1 | 7/2001 | Sardanopoli et al. | 264/211.23 |
| 6,277,036 | B1 | 8/2001 | Hayashi et al. | 473/376 |
| 6,315,680 | B1 | 11/2001 | Dalton et al. | 473/373 |
| 6,315,684 | B1 | 11/2001 | Binette et al. | 473/377 |
| 6,319,152 | B1 | 11/2001 | Takesue et al. | 473/371 |
| 6,325,730 | B1 | 12/2001 | Binette et al. | 473/377 |
| 6,329,458 | B1 | 12/2001 | Takesue et al. | 524/400 |
| 6,353,058 | B1 | 3/2002 | Rajagopalan | 525/179 |
| 6,361,453 | B1 | 3/2002 | Nakamura et al. | 473/371 |
| 6,369,125 | B1 | 4/2002 | Nesbitt | 522/142 |
| 6,413,170 | B1 | 7/2002 | Binette et al. | 473/377 |
| 6,413,172 | B1 | 7/2002 | Binette | 473/378 |
| 6,416,424 | B1 | 7/2002 | Sullivan | 473/374 |
| 6,419,594 | B1 | 7/2002 | Nesbitt et al. | 473/371 |
| 6,425,833 | B1 | 7/2002 | Sullivan et al. | 473/373 |
| 6,435,987 | B1 | 8/2002 | Dewanjee | 473/378 |
| 6,441,095 | B1 | 8/2002 | Keller et al. | 525/221 |
| 6,450,899 | B1 | 9/2002 | Binette et al. | 473/376 |
| 6,454,666 | B1 | 9/2002 | Shira | 473/377 |
| 6,458,891 | B1 | 10/2002 | Yonezawa et al. | 525/88 |
| 6,458,892 | B1 | 10/2002 | Rajagopalan et al. | 525/92 C |
| 6,475,417 | B1 | 11/2002 | Nesbitt et al. | 264/134 |
| 6,482,109 | B1 | 11/2002 | Nesbitt et al. | 473/373 |
| 6,482,345 | B1 | 11/2002 | Dewanjee | 264/254 |
| 6,486,261 | B1 | 11/2002 | Wu et al. | 525/332.6 |

(Continued)

FOREIGN PATENT DOCUMENTS

| | | |
|---|---|---|
| CA | 2140169 | 1/1995 |

*Primary Examiner*—Raeann Gorden
(74) *Attorney, Agent, or Firm*—Sheppard, Mullin, Richter & Hampton LLP

(57) ABSTRACT

Golf ball covers incorporate base material compositions including a sound-altering material for selectively enhancing or dampening the acoustic output of a golf ball when it is struck. A ratio in the composition by weight of base material to sound-altering material ranges between 99.9:0.1 and 92:8. The invention allows for the altering of the sound of the golf ball while retaining the mechanical properties of the golf ball cover.

3 Claims, No Drawings

U.S. PATENT DOCUMENTS

| | | | | |
|---|---|---|---|---|
| 6,780,933 | B1 * | 8/2004 | Rajagopalan et al. | 525/92 A |
| 2001/0018496 | A1 | 8/2001 | Wu | 525/263 |
| 2002/0013185 | A1 | 1/2002 | Sullivan et al. | 473/377 |
| 2002/0016435 | A1 | 2/2002 | Simonutti et al. | 528/59 |
| 2002/0022537 | A1 | 2/2002 | Nesbitt et al. | 473/378 |
| 2002/0028885 | A1 | 3/2002 | Sullivan et al. | 525/221 |
| 2002/0034989 | A1 | 3/2002 | Sullivan et al. | 473/373 |
| 2002/0119835 | A1 | 8/2002 | Sullivan et al. | 473/373 |

* cited by examiner

GOLF BALLS HAVING SOUND-ALTERED LAYERS AND METHODS FOR MAKING THEM

BACKGROUND OF THE INVENTION

The present invention relates to cover layers for golf balls incorporating material compositions having relatively small amounts of sound-altering materials mixed therein, such that sound produced by the golf balls when struck is selectively altered, while the mechanical characteristics of the covers remain substantially the same. The present invention also relates to methods of manufacture of golf ball covers incorporating these sound-altering materials.

Golf balls generally include a core and at least one cover layer surrounding the core. Balls can be classified as two-piece, multi layer, or wound balls. Two-piece balls include a spherical inner core and an outer cover layer. Multi-layer balls include a core, a cover layer and one or more intermediate (or mantle) layers. The intermediate layers themselves may include multiple layers. Wound balls include a core, a rubber thread wound under tension around the core to a desired diameter, and a cover layer, typically of balata material or thermoset polyurethane.

Generally, two-piece balls provide good durability and ball distance when hit, but they provide poor ball control, due to low spin rate and poor "feel" (the overall sensation transmitted to the golfer while hitting the ball). Wound balls having balata covers generally have high spin rate, leading to good control, and good feel, but they have short distance and poor durability in comparison to two-piece balls. Multi-layer balls generally have performance characteristics between those of two-piece and wound balls. Multi-layer balls exhibit distance and durability inferior to two-piece balls but superior to wound balata, and they exhibit feel and spin rate inferior to wound balata and thermoset polyurethane balls but superior to two-piece balls. Thermoset polyurethane covers tend to have very good durability, but they have not yet attained the preferred feeling of balata.

Material characteristics of the compositions used in the core, cover, and any intermediate layers are important in determining the performance of the resulting golf balls. In particular, the composition of the cover layer is important in determining the ball's durability, scuff resistance, speed, shear resistance, spin rate, feel, and "click" (the sound made when a golf club head strikes the ball). Various materials having different physical properties are used to make cover layers to create a ball having the most desirable performance possible. For example, many modern cover layers are made using soft or hard ionomer resins, elastomeric resins or blends of these. Ionomeric resins used generally are ionic copolymers of an olefin and a metal salt of an unsaturated carboxylic acid, or ionomer terpolymers having a co-monomer within its structure. These resins vary in resiliency, flexural modulus, and hardness. Examples of these resins include those marketed under the name SURLYN manufactured by E.I. DuPont de Nemours & Company of Wilmington, Del., and IOTEK manufactured by ExxonMobil Corporation of Irving, Tex. Elastomeric resins used in golf ball covers include a variety of thermoplastic or thermoset elastomers available. Layers other than cover layers also significantly affect performance of a ball. The composition of an intermediate layer is important in determining the ball's spin rate, speed, and durability. The composition and resulting mechanical properties of the core are important in determining the ball's coefficient of restitution (C.O.R.), which affects ball speed and distance when hit. In addition to the performance factors discussed above, processability also is considered when selecting a formulation for a golf ball composition. Good processability allows for ease of manufacture using a variety of methods known for making golf ball layers, while poor processability can lead to avoidance of use of particular materials, even when those materials provide for good mechanical properties.

Various materials having different physical properties are used to make ball layers to create a ball having the most desirable performance possible. Each of the materials discussed above has particular characteristics that can lead to ball properties when used in a golf ball composition, either for making a ball cover, intermediate layer, or core. However, one material generally cannot optimize all of the important properties of a golf ball layer. Properties such as feel, speed, spin rate, resilience and durability all are important, but improvement of one of these properties by use of a particular material often can lead to worsening of another. For example, ideally, a golf ball cover should have good feel and controllability, without sacrificing ball speed, distance, or durability. Despite the broad use of copolymeric ionomers in golf balls, their use alone in, for example, a ball cover can be unsatisfactory. A cover providing good durability, controllability, and feel would be difficult to make using only a copolymeric ionomer resin having a high flexural modulus, because the resulting cover, while having good distance and durability, also will have poor feel and low spin rate, leading to reduced controllability of the ball. Also, the use of particular elastomeric resins alone can lead to compositions having unsatisfactory properties, such as poor durability and low ball speed.

Therefore, to improve golf ball properties, the materials discussed above can be blended to produce improved ball layers. Prior compositions for golf balls have involved blending high-modulus copolymeric ionomer with, for example, lower-modulus copolymeric ionomer, terpolymeric ionomer, or elastomer. As discussed above, ideally a golf ball cover should provide good feel and controllability, without sacrificing the ball's distance and durability. Therefore, a copolymeric ionomer having a high flexural modulus often is combined in a cover composition with a terpolymeric ionomer or an elastomer having a low flexural modulus. The resulting intermediate-modulus blend possesses a good combination of hardness, spin and durability.

However, even with blending of materials to improve ball properties, use of the materials and blends discussed above has not been completely satisfactory. Improving one characteristic can lead to worsening of another. For example, blending an ionomer having a high flexural modulus with an ionomer having a low flexural modulus can lead to reduced resilience and durability compared to use of the high-modulus ionomer alone. Also, the hardness of the compositions that can be obtained from these blends are limited, because durability and resilience get worse when hardness is lowered by increasing terpolymeric content of these blends. In general, it is difficult to make materials for use in, for example, a golf ball cover layer that possess good feel, high speed, high resilience, and good shear durability, and that are within a wide range of hardness. Additional compositions meeting these criteria are therefore needed.

In the past, in addition to the materials discussed above, fillers have been added to base material compositions used in the construction of golf balls. The filler generally has been added for one of two purposes: 1) as a reinforcing agent; or 2) to adjust the weight or density of a composition used in the formation of golf ball cores, intermediate layers, or covers. The prior art is replete with examples of both.

Descriptions of use of fillers reinforcing agents are found in, for example, U.S. Pat. No. 3,883,145 to Cox et al. discloses hydrated silica and barytes as reinforcing material. U.S. Pat. No. 5,759,676 to Cavallaro et al. discloses addition of glass fibers to cover material as a reinforcing agent. This also is shown in commonly-owned U.S. Pat. No. 6,012,991 to Kim et al., which discloses glass fibers used as a reinforcing agent in a golf ball intermediate layer composition. U.S. Pat. No. 4,836,552 to Puckett discloses incorporation of glass bubbles into a ball material composition to improve impact resistance.

Descriptions of fillers used to modify the density or weight of a golf ball composition include U.S. Pat. No. 1,369,868 to Worthington, which discloses the addition of wolframite to the core of a golf ball. The addition of wolframite increases the overall density of the core so that additional weight and, as a consequence, additional ball flight are obtained. U.S. Pat. No. 3,671,477 to Nesbitt describes the addition of filler material to a golf ball to control its weight without affecting its resilience. The filler used in the Nesbitt patent preferably includes 20 to 40 parts per hundred by weight of hydrated silica. U.S. Pat. No. 4,863,167 to Matsuki discloses addition of heavy fillers such as tungsten and lead to a mantle layer of a golf ball to push weight away from the core of the golf ball. The Matsuki patent also utilizes composition fillers such as zinc oxide, barium sulfate, silica and zinc carbonate to maintain correct weight proportions for the cover and core of the disclosed golf ball. U.S. Pat. No. 5,312,587 to Sullivan discloses the use of high ratio quantities of metal stearates in compositions to act as fillers without reducing C.O.R. values. The Sullivan patent states that such a use is beneficial for reducing the material costs of golf ball compositions. The Sullivan patent also points out that small amounts of zinc stearate (i.e., from 0.01 to 1.0 pph) previously had been used in the golf ball industry for facilitating the flow of ionomer resins, and that the improvements of metal stearates as a filler are only shown when the amounts used are greater than 10 pph of ionomer resin. U.S. Pat. No. 6,123,929 to Gonzenbach et al. discloses use of glass fibers, barium sulfate and metal stearates as a filler material for manipulating the density of the golf ball compositions used.

The examples discussed above generally include large amount of filler material, usually greater than 5 pph of the base composition, and often greater than 20 pph of the base composition. These large amounts are required for the filler material performs its function, either as a reinforcing agent or as a weight/density-modifying material. From another perspective, it is seen that the fillers previously have been added with the explicit purpose of altering the generally tested mechanical properties of a golf ball (i.e., C.O.R., weight, shear resistance, and spin) without regard to any change in non-mechanical properties that may occur due to the addition of the filler material.

Of the physical characteristics of a golf ball, the two most sought are high resilience and good feel. High resilience gives a ball added distance, which is particularly desired by casual golfers. However, high resilience balls (also known as distance balls) generally are considered hard golf balls and do not provide good feel for pitch shots and putting. A golf ball having what is called good feel typically is softer than its distance counterpart. This gives the golfer more confidence to control the distance of a putt or a pitch shot, but it offers less distance for long shots. The perceived feel of a ball is determined by more, however, than its compression and resilience characteristics. When determining the feel of a golf ball, most avid golfers, from casual to professional, are sensitive to the sound of the ball when struck. A louder, higher-pitched sound is associated with a hard, high resilience ball, while a softer, lower-pitched sound is associated with a soft ball.

Testing of sound characteristics when struck has been performed on golf balls. A particular family of patents discloses frequencies of specific golf balls materials. These patents include U.S. Pat. Nos. 5,971,870, 6,425,833, 6,142,866 and 6,152,835, collectively assigned to Spalding Sports Worldwide, Inc. These patents discloses a golf ball made from a material, such that the golf ball has a primary minimum value in a frequency range of 3100 Hz or less. An explanation follows of what causes the audible sound emitted from a golf ball when it is struck by a golf club and how that sound is measured.

A golf ball, when it is struck, is contracted along a primary diameter from the point tangent to where the golf ball was struck. The golf ball has a fixed circumference, and any contraction along the primary diameter causes a secondary diameter, perpendicular to the primary diameter, to elongate as it compensates for the narrowing of the primary diameter. Though this happens in three dimensions, it can be thought of as horizontal line X and vertical line Y, wherein X is synonymous with the primary diameter and Y is synonymous with the secondary diameter. The sum of their lengths remains equal, thus, an extension of one necessitates a narrowing of the other, and vice versa. The resiliency of the material causes the now-narrowed primary diameter to expand back to and beyond its original length, while the secondary diameter contracts to a length less than its original length. The deformation of the golf ball diameters between extension and contraction defines an oscillation (or pressure pulse) that vibrates against air molecules. The vibration of the air molecules is, in effect, the sound that we hear. The contraction and extension of the golf ball is greatest along the primary diameter and second diameters, because the primary diameter is tangent to where the ball was struck. Because the primary and secondary diameters oscillate more than other diameters of the golf ball, the oscillation of the primary and secondary diameters define the first acoustic mode which generates the most audible pressure pulse. In the above-mentioned Spalding patents, this first acoustic mode is called the primary value. The purpose of the inventions disclosed in these patents is to produce a cover material having a specific first acoustic mode having a frequency lower than 3100 kilohertz however, in these patents, no effort was made to alter either the decibel level or the frequency of the materials produced.

Because a golf ball is solid, it cannot oscillate only between two diameters or even two perpendicular planes. The solid nature of the ball causes additional oscillations on planes that are not coplanar with either the primary or secondary diameters. Additional acoustic modes are caused by oscillations along other diameters and include a great number of diameters. The second acoustic mode includes elongation and contraction along three diameters that intersect each other, the third acoustic mode includes four diameters and so on. While theoretically there is no limit to the number of acoustics modes, as spheres have an infinite number of diameters, there is a limit to which we can pick out the nodes with sound listening equipment. As the energy input increases, higher order acoustic modes are excited. Generally, the oscillations of these acoustic modes are small and their frequencies are too high for the human ear to detect. For that reason, it is generally the first, second, and sometimes third, acoustic modes that are the most important acoustic modes. Also, altering the frequency of the first acoustic mode will alter the frequency of the remaining acoustic modes. Thus, lowering the frequency of the first acoustic mode will lower the frequency of the second and third acoustic modes, so that the overall sound detected has a lower frequency.

The frequency of the golf ball is most important to altering the perceived sound of the ball when struck when putting or making short shots, such as pitching onto a green. Thhis is because a golf ball struck with a longer club, such a driver, does not oscillate as much as the head of the club which struck the ball. For that reason, when a golfer strikes a golf ball with a driver, the driver primarily provides the sound that is heard, and little is given to the golfer in the way of soft or hard impressions relating to the ball. Conversely, when a golfer strikes a ball with a putter, the mass of the putter and ease of the stroke cause little oscillation in the putter and therefore the "click" of the golf ball is heard.

Another way to measure sound with respect to golf ball constructions and materials is to primarily rely on decibel levels. The decibel level includes all of the acoustic modes and is a function of how much sound is emitted from the material when it is struck. Decibels are converted from Pascals, which indicate the magnitude and duration of the pressure pulse associated with the sound. A ball emitting a smaller pressure pulse (lower Pascal output) will give the impression of a softer feeling. This is true even if measurements of the C.O.R. indicate that the material properties of the golf ball have remained essentially the same.

Golf balls having a high pitch or high acoustic output are viewed as too hard, while balls having a low pitch or low acoustic output are perceived as a ball having a short flight distance. This perception holds true regardless of the actual mechanical properties of the golf ball in question. In view of this problem and the ones stated above, it is apparent that a method to adjust the frequency or Pascal output for golf balls, while retaining the C.O.R. of the golf balls, as well as the golf balls including such features, is needed. This will allow the manufacturer to adjust the sound of the golf ball so that it is tuned to the satisfaction of a golfer, while retaining the mechanical properties (i.e., C.O.R., resilience) of the ball. The present invention fulfills this need and provides further related advantages.

SUMMARY OF THE INVENTION

The present invention relates to new and improved golf balls that overcome the above-referenced problems. An object of the invention is to form a cover or cover layers for a golf ball comprising a base composition and a sound-altering material. Golf balls within the scope of the invention can be solid, wound, two-piece, or multi-layered golf balls.

More specifically, the present invention resides in a golf ball having a core and one or more cover layers encasing the core, in which at least one of the cover layers incorporates a composition comprising a base material, and a sound-altering material, in which the ratio by weight of base material to sound-altering material ranges between 99.9:0.1 and about 92:8. The sound-altering material is configured to alter the sound produced when the golf ball is struck, without substantially altering other properties of the golf ball. The sound-altering material can be either a sound-enhancing material configured to increase the sound output produced when the golf ball is struck, or a sound-dampening material configured to decrease the sound output produced when the golf ball is struck. Preferred sound-enhancing materials include metal stearates, such as zinc stearate or calcium stearate, or solid glass beads, optionally having a surface treatment. Preferred sound-dampening materials include carbonates and sulfates, such as barium sulfate, and hollow glass beads, optionally having a surface treatment.

In preferred embodiments of the compositions, the ratio by weight of base material to sound-altering material ranges between 99.9:0.1 and about 92:8, more preferably between 99.9:0.1 and about 95:5, more preferably between 99:1 and about 95:5, and most preferably between 98:2 and about 95:5. The base material preferably incorporates nonionomeric or ionomeric polymers, or mixtures of these. Preferred nonionomeric polymers include thermoplastic polyurethane, thermoset polyurethane, polyamide, silicone material, thermoplastic elastomers, syndiotactic 1,2-polybutadiene, ethylene-vinyl-acetate, styrenic copolymers, styrenic terpolymers, polymers having functional groups, or mixtures of these. Preferred ionomeric materials include copolymeric ionomer, terpolymeric ionomer, or mixtures of these. The base material also can include UV stabilizers, photostabilizers, antioxidants, colorants, dispersants, mold releasing agents, processing aids, fibers, fillers, or mixtures of these.

Golf balls within the scope of the present invention can incorporate multiple cover layers, in which the outer or one of the inner cover layers incorporates the composition. Golf balls within the scope of the present invention can have a variety of constructions, including: one or more intermediate layers situated between the core and the cover layer; an inner core and one or more outer cores encasing the inner core; a core incorporating liquid; or, a layer of rubber thread situated between the core and the cover layer. If the ball incorporates a layer of rubber thread, the rubber thread also can incorporate the composition of the present invention.

Preferably, the acoustic pulse difference between the base material combined with the sound-altering material and the base material alone has a value between 0.01 and 0.09 Pascals, or greater than 0.05 Pascals.

Related methods for preparing a golf ball layer, incorporate preparing a composition comprising a base material; and a sound-altering material, in which the ratio by weight of base material to sound-altering material ranges between 99.9:0.1 and 92:8, and forming the composition into a golf ball layer positioned around a golf ball core. The composition can be formed into a layer using injection molding, dry-blending, or mixing using a mill, internal mixer or extruder. The sound-altering material can be premixed with the base material to form a concentrate of sound-altering material, and mixing the concentrate into a mixture incorporating the base material. The composition can be formed into a layer by, for example, forming the composition into half cups, positioning the half cups over the core so that the core is covered by the half cups, and increasing thermal energy to and pressure on the half cups so that the half cups are bonded together to form a layer.

Other features and advantages of the present invention should become apparent from the following detailed description of the preferred embodiments.

DETAILED DESCRIPTION OF THE PREFERRED EMBODIMENTS

The present invention is embodied in golf balls having cover layers incorporating compositions incorporating a base composition and a sound-altering material. The present invention also is embodied in golf ball cover layers made from the above-specified composition, and it additionally resides in methods of manufacture of balls incorporating these cover layers. The invention also resides in balls incorporating layers of wound rubber thread that incorporate a sound-altering material. The combination of the base composition and sound-altering material allows for formation of golf ball cover layers that are provide the performance of hard covers, including high C.O.R. and shear resistance, while offering the sound and perception of soft covers. The composition also allows for providing golf balls having essentially identical physical parameters with a different sound upon being struck with a putter.

It has been found that the addition of relatively small amounts of sound-altering material may be added to the cover material of the golf ball to selectively alter the sound of the golf ball while retaining the remaining physical mechanics of the cover material. For example, with the addition of a sound-altering material to a golf ball having a hard cover, a golfer would be provided with a golf ball cover offering a high resilience for longer drives but the perception of a soft ball on the greens. Another example includes the addition of a sound-altering material to a golf ball having a soft cover so that the golfer is provided with a ball having low resilience for good control but the perception of a hard ball for long shots.

Preferred embodiments of the present invention suitable for use in make golf ball covers include compositions comprising a base material or resin and a sound-altering material. Preferably, the ratio by weight of base material to sound-altering material ranges between 99.9:0.1 and about 92:8, more preferably between 99.9:0.1 and about 95:5, even more preferably between 99:1 and about 95:5, and most preferably between 98:2 and about 95:5.

The base material generally may include any material that is conventionally used in the forming of golf ball covers. These materials can typically be grouped into ionomeric materials and non-ionomeric materials and blends of these. Non-ionomeric materials generally include balata, trans-polyisoprene (synthetic balata), silicones, thermoplastic polyurethanes, thermoset polyurethanes, polyamides, 1,2-polybutadiene, thermoplastic elastomers, polymers with functional groups and polyester elastomers. Monomeric materials generally include copolymeric ionomers and terpolymeric ionomers.

The base material used within the scope of the present invention also can include, in suitable amounts, one or more additional ingredients or additives for achieving specific functions when generally employed in golf balls and ball compositions. Suitable ingredients include UV stabilizers, photostabilizers, antioxidants, colorants, dispersants, mold releasing agents, processing aids, and inorganic fillers. The compositions can incorporate, for example, metallic fillers, such as titanium dioxide, calcium carbonate, zinc sulfide or zinc oxide. Additional fillers, such as those mentioned in the above cited patents, can be chosen to impart additional density to the compositions, such as zinc oxide, tungsten or any other metallic powder having density higher than that of the base polymeric resin. An example of these is silica-reinforcing filler. This filler preferably is selected from finely divided, heat-stable minerals, such as fumed and precipitated forms of silica, silica aerogels and titanium dioxide having a specific surface area of at least about 10 $m^2$/gram. Any organic, inorganic, or metallic fibers, either continuous or non-continuous, also can be in the compositions.

A. Non-Ionomeric Materials

1. Polyurethane

Polyurethane can be obtained from the reaction product of polyol and diisocynate. For example, in one method, polyol having macromolecule and organic polyisocyanate react to produce urethane prepolymer, and thus urethane prepolymer reacts with a chain extender, such as polyol, diisocyanate, diamines, or mixtures of these. Polyurethanes that are particularly suitable for making compositions of the present invention are curable polyurethanes including urethane prepolymers. The chemical components for making curable thermoplastic polyurethanes are discussed below.

a. Isocyanates

Suitable isocyanates include: trimethylene diisocyanate, tetramethylene diisocyanate, pentamethylene diisocyanate, hexamethylene diisocyanate, ethylene diisocyanate, diethylidene diisocyanate, propylene diisocyanate, butylenes diisocyanate, bitolylene diisocyanate, tolidine isocyanate, isophorone diisocyanate, dimeryl diisocyanate, dodecane-1, 12-diisocyanate, 1,10-decamethylene diisocyanate, cyclohexylene-1,2-diisocyanate, 1,10-decamethylene diisocyanate, 1-chlorobenzene-2,4-diisocyanate, furfurylidene diisocyanate, 2,4,4-trimethyl hexamethylene diisocyanate, 2,2,4-trimethyl hexamethylene diisocyanate, dodecamethylene diisocyanate, 1,3-cyclopentane diisocyanate, 1,3-cyclohexane diisocyanate, 1,3-cyclobutane diisocyanate, 1,4-cyclohexane diisocyanate, 4,4'-methylenebis(cyclohexyl isocyanate), 4,4'-methylenebis(phenyl isocyanate), 1-methyl-2,4-cyclohexane diisocyanate, 1-methyl-2,6-cyclohexane diisocyanate, 1,3-bis (isocyanato-methyl)cyclohexane, 1,6-diisocyanato-2,2,4,4-tetra-methylhexane, 1,6-diisocyanato-2,4,4-tetra-trimethylhexane, trans-cyclohexane-1,4-diisocyanate, 3-isocyanato-methyl-3,5,5-trimethylcyclohexyl isocyanate, 1-isocyanato-3,3,5-trimethyl-5-isocyanatomethylcyclohexane, cyclo-hexyl isocyanate, dicyclohexyl-methane 4,4'-diisocyanate, 1,4-bis(isocyanatomethyl) cyclohexane, m-phenylene diisocyanate, m-xylylene diisocyanate, m-tetramethylxylylene diisocyanate, p-phenylene diisocyanate, p, p'-biphenyl diisocyanate, 3,3'-dimethyl-4,4'-biphenylene diisocyanate, 3,3'-dimethoxy-4,4'-biphenylene diisocyanate, 3,3'-diphenyl-4,4'-biphenylene diisocyanate, 4,4'-biphenylene diisocyanate, 3,3'-dichloro-4,4'-biphenylene diisocyanate, 1,5-naphthalene diisocyanate, 4-chloro-1,3-phenylene diisocyanate, 1,5-tetrahydronaphthalene diisocyanate, metaxylene diisocyanate, 2,4-toluene diisocyanate, 2,4'-diphenylmethane diisocyanate, 2,4-chlorophenylene diisocyanate, 4,4'-diphenylmethane diisocyanate, p,p'-diphenylmethane diisocyanate, 2,4-tolylene diisocyanate, 2,6-tolylene diisocyanate, 2,2-diphenylpropane-4,4'-diisocyanate, 4,4'-toluidine diisocyanate, dianidine diisocyanate, 4,4'-diphenyl ether diisocyanate, 1, 3-xylylene diisocyanate, 1,4-naphthylene diisocyanate, azobenzene-4,4'-diisocyanate, diphenyl sulfone-4,4'-diisocyanate, triphenylmethane 4,4',4"-triisocyanate, isocyanatoethyl methacrylate, 3-isopropenyl-$\alpha,\alpha$-lydimethylbenzyl-isocyanate, dichlorohexamethylene diisocyanate, ($\omega$, $\omega$'-diisocyanato-1,4-diethylbenzene, polymethylene polyphenylene polyisocyanate, and isocyanurate modified compounds, carbodiimide modified compounds and biuret modified compounds of the above polyisocyanates. These may be used either alone or in combination. Also suitable are triisocyanates such as biuret of hexamethylene diisocyanate and triphenylmethane triisocyanate, and polyisocyanates such as polymeric diphenylmethane diisocyanate.

b. Polyols

Suitable polyols include polyester polyol, polyether polyol, polycaprolactone polyol, polycarbonate polyol and polybutadiene polyol, or mixtures of these.

(i) Polyester Polyols

Polyester polyols are prepared by condensation or step-growth polymerization. The main diacids for polyester polyols are adipic acid and the three isomeric phthalic acids. Adipic acid is used for applications requiring flexibility, whereas phthalic anhydride is used for those requiring rigidity poly(ethylene adipate) (PEA), poly(diethylene adipate) (PDA), poly(propylene adipate) (PPA), poly(tetramethylene adipate) (PBA), poly(hexamethylene adipate) (PHA), poly(neopentylene adipate) (PNA), polyol composed of 3-methyl-1,5-pentanediol and adipic acid, random copolymer of PEA and PDA, random copolymer of PEA and PPA, random copolymer of PEA and PBA, random copolymer of PHA and PNA, caprolactone polyol obtained by the ring-opening polymerization of ϵ-caprolactone, and polyol obtained by opening the ring of β-methyl-δ-valerolactone with ethylene glycol, can be used either alone or in a combination thereof. Preferably, those polyols have molecular weights of at least 500. Additionally, the polyester polyol may be composed of a copolymer of at least one of the following acids and at least one of the following glycols.

Suitable acids include: Terephthalic acid, isophthalic acid, phthalic anhydride, oxalic acid, malonic acid, succinic acid, pentanedioic acid, hexanedioic acid, octanedioic acid, nonanedioic acid, adipic acid, azelaic acid, sebacic acid, dodecanedioic acid, dimer acid (a mixture), ρ-hydroxybenzoate, trimellitic anhydride, ϵ-caprolactone, and β-methyl-δ-valerolactone.

Suitable glycols include: Ethylene glycol, propylene glycol, butylene glycol, pentylene glycol, 1,4-butanediol, 1,5-pentanediol, 1,6-hexanediol, neopentylene glycol, polyethylene glycol, polytetramethylene glycol, 1,4-cyclohexane dimethanol, pentaerythritol, and 3-methyl-1,5-pentanediol.

(ii) Polyether Polyols

Polyether polyols are prepared by the ring-opening addition polymerization of an alkylene oxide (e.g. ethylene oxide and propylene oxide) with an initiator of a polyhydric alcohol (e.g. diethylene glycol), which is an active hydride. Specifically, polypropylene glycol (PPG), polyethylene glycol (PEG) or propylene oxide-ethylene oxide copolymer can be obtained. Polytetramethylene ether glycol (PTMG) is prepared by the ring-opening polymerization of tetrahydrofuran, produced by dehydration of 1,4-butanediol or hydrogenation of furan. Tetrahydrofuran can form a copolymer with other alkylene oxide. Specifically, tetrahydrofuran-propylene oxide copolymer or tetrahydrofuran-ethylene oxide copolymer can be formed. The above polyols preferably have molecular weight of at least 500 and may be used either alone or in a combination.

(iii) Polycarbonate Polyols

Polycarbonate polyol is obtained by the condensation of a known polyol (polyhydric alcohol) with phosgene, chloroformic acid ester, dialkyl carbonate or diallyl carbonate. It varies in molecular weight. Particularly preferred polycarbonate polyol contains a polyol component using 1,6-hexanediol, 1,4-butanediol, 1,3-butanediol, neopentylglycol or 1,5-pentanediol. They have molecular weight of at least 500 and can be used either alone or in a combination.

(iv) Polybutadiene Polyol

Polybutadiene polyol includes the following. The liquid diene polymer containing hydroxyl groups has a molecular weight of at least 600 and an average number of functional groups at least 1.7, and they may be composed of diene polymer or diene copolymer, having at least 4 carbon atoms, or a copolymer of such diene monomer with addition polymerizable α-olefin monomer, having at least 2 carbon atoms. Specific examples include butadiene homopolymer, isoprene homopolymer, butadiene-styrene copolymer, butadiene-isoprene copolymer, butadiene-acrylonitrile copolymer, butadiene-2-ethyl hexyl acrylate copolymer, and butadiene-n-octadecyl acrylate copolymer. These liquid diene polymers can be obtained, for example, by heating a conjugated diene monomer with the presence of hydrogen peroxide in a liquid reactant.

c. Plasticizers

Suitable plasticizers include: dioctyl phthalate (DOP), dibutyl phthalate (DBP), dioctyl adipate (DOA), triethylene glycol dibenzoate, tricresyl phosphate, dioctyl phthalate, aliphatic ester of pentaerythritol, dioctyl sebacate, diisooctyl azelate.

d. Extenders

Suitable extenders and/or curatives used in the present invention may be any material generally used for hardening urethane prepolymer to produce polyurethane elastomer. Non-limiting examples include polyols, polyamine compounds, and mixtures of these. Polyol extenders may be primary, secondary, or tertiary polyols. Specific examples of monomers of these polyols include the following: trimethylolpropane (TMP), ethylene glycol, 1,3-propanediol, 1,4-butanediol, 1,5-pentanediol, 1,6-hexanediol, propylene glycol, dipropylene glycol, 1,2-butanediol, 1,3-butanediol, 2,3-butanediol, 1,2-pentanediol, 2,3-pentanediol, 2,5-hexanediol, 2,4-hexanediol, 2-ethyl-1,3-hexanediol, cyclohexanediol, and 2-ethyl-2-(hydroxymethyl)-1,3-propanediol. Diamines also can be added to urethane prepolymer to function as chain extenders. Suitable diamines include: tetramethylenediamine, pentamethylenediamine, hexamethylenediamine, p,p'-methylenedianiline, p-phenylenediamine and others. Aromatic diamines have a tendency to provide a stiffer (higher Mooney viscosity) product than aliphatic or cycloaliphatic diamines. Suitable polyamines that can be used as chain extenders include, any of a primary amine, a secondary amine and a tertiary amine, such as diamine, triamine and tetramine. Examples of these include: an aliphatic amine such as hexamethylenediamine; an alicyclic amine such as 3,3'-dimethyl-4,4'-diaminodicyclohexyl methane; an aromatic amine such as 4,4'-methylene bis-2-chloroaniline, 2,2',3,3'-tetrachloro-4,4'-diaminophenyl methane or 4,4'-diaminodiphenyl; and 2,4,6-tris(dimethylaminomethyl) phenol. These extenders may be used either alone or in combination. Urethane prepolymer may be hardened by mixing it with chain extender using conventional methods, or by varying a mix ratio of the extender to the urethane prepolymer under proper processing conditions, such as processing temperature and processing time.

2. Polyamides

Suitable polyamides for use as an additional material in compositions within the scope of the present invention also include resins obtained by: (1) polycondensation of (a) a dicarboxylic acid, such as oxalic acid, adipic acid, sebacic acid, terephthalic acid, isophthalic acid or 1,4-cyclohexylidicarboxylic acid, with (b) a diamine, such as ethylenediamine, tetramethylenediamine, pentamethylenediamine, hexamethylene-diamine or decamethylenediamine, 1,4-cyclohexyldiamine or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononaoic acid, 11-aminoudecanoic acid or 12-aminododecanoic acid; or, (4) copolymerization of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

3. 1,2-polybutadiene

Syndiotactic 1,2-polybutadiene having crystallinity suitable for use in compositions within the scope of the present invention are polymerized from 1,2_addition of butadiene.

These include syndiotactic 1,2-polybutadiene having crystallinity and having greater than about 70% of 1,2_bonds, more preferably greater than about 80%, and most preferably greater than about 90%. These syndiotactic 1,2-polybutadienes have crystallinity between about 5% and about 50%, more preferably about 10% and about 40%, and most preferably between about 15% and about 30%. These syndiotactic 1,2-polybutadienes have a mean molecular weight between about 10,000 and about 350,000, more preferably between about 50,000 and about 300,000, more preferably between about 80,000 and about 200,000, and most preferably between about 10,000 and about 150,000. An example of a suitable syndiotactic 1,2-polybutadiene for use in the scope of the present invention polybutadiene is sold under the trade name RB810, RB820, and RB830 by JSR Corporation of Tokyo, Japan. These have more than 90% of 1,2 bonds, mean molecular weight of approximately 120,000, and crystallinity between about 15% and 30%.

4. Silicones

Silicone materials also are well suited for blending into compositions within the scope of the present invention. These can be monomers, oligomers, prepolymers, or polymers, with or without additional reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl and hexyl; cycloalkyl groups, such as cyclohexyl and cycloheptyl, aryl groups such as phenyl, tolyl and xylyl; aralkyl groups, such as benzyl and phenethyl; and halogenated alkyl groups, such as 3,3,3-trifluoropropyl and chloromethyl. Another type of silicone material suitable for use in the present invention is one having hydrocarbon groups that lack aliphatic unsaturation. Specific examples of suitable silicones for use in making compositions of the present invention include the following: trimethylsiloxy-endblocked dimethylsiloxane-methylhexenylsiloxane copolymers, dimethylhexenlylsiloxy-endblocked dimethylsiloxane-methylhexenylsiloxane copolymers; trimethylsiloxy-endblocked dimethylsiloxane-methylvinylsiloxane copolymers; trimethylsiloxy-endblocked methylphenylsiloxane-dimethylsiloxane-methylvinylsiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and, the copolymers listed above, in which at least one end group is dimethylhydroxysiloxy. Commercially available silicones suitable for use in compositions within the scope of the present invention include Silastic by Dow Corning Corp. of Midland, Mich., Blensil by GE Silicones of Waterford, N.Y., and Elastosil by Wacker Silicones of Adrian, Mich.

5. Thermoplastic Elastomers

Thermoplastic elastomers for use within the scope of the present invention include polyester elastomers marketed under the name SKYPEL by SK Chemicals of South Korea or HYTREL from DuPont. Also of use are triblock copolymers marketed under the name HG-252 by Kuraray Corporation of Kurashiki, Japan. These triblock copolymers have at least one polymer block comprising an aromatic vinyl compound and at least one polymer block comprising a conjugated diene compound, and a hydroxyl group at a block copolymer. Also preferred are polyamide elastomers and in particular polyetheramide elastomers. Of these, suitable thermoplastic polyetheramides are chosen from among the family of Pebax, which are available from Elf-Atochem Company. The materials listed above all can provide for particular enhancements to ball layers prepared within the scope of the present invention.

6. Polymers Having Functional Groups

Among thermoplastic elastomers with functional or polar groups that are contemplated are thermoplastic elastomers with functional groups, such as carboxylic acid, maleic anhydride, glycidyl, norbonene, and hydroxyl group. Examples are maleic anhydride functionalized triblock copolymer consisting of polystyrene end blocks and poly (ethylene/butylene); maleic anhydride modified ethylene-vinyl acetate copolymer; ethylene-isobutyl acrylate-methacrylic acid terpolymer; ethylene-ethyl acrylate-maleic anhydride terpolymer and ethylene-ethyl acrylate-maleic anhydride terpolymer; bromonated styrene-isobutylene copolymers; Lotader resins having glycidyl or maleic anhydride functional groups; and mixtures of the above resins.

Examples of suitable additional polymers for use in the present invention include, but are not limited to, the following: thermoset elastomer, synthetic rubber, thermoplastic vulcanizate, polycarbonate, polyesters, polyvinyl alcohols, acrylonitrile-butadiene-styrene copolymers, polyarylate, polyacrylate, polyphenyl ether, modified-polyphenyl ether, high-impact polystyrene, diallyl phthalate polymer, metallocene catalyzed polymers, acrylonitrile—styrene-butadiene (ABS), styrene-acrylonitrile (SAN) (including olefin-modified SAN and acrilonitrile styrene acrylonitrile), styrene-maleic anhydryde (S/MA) polymer, styrenic copolymer, functionalized styrenic copolymer, functionalized styrenic terpolymer, styrenic terpolymer, cellulose polymer, liquid crystal polymer LCP), ethylene-propylene-diene terpolymer (EPDM), ethylene-vinyl acetate copolymers (EVA), ethylene-propylene copolymer, ethylene vinyl acetate, and polyurea or any metallocene-catalyzed polymers of these species. Particularly suitable plasticizers for use in the compositions within the scope of the present invention include: polyethylene-terephthalate, polybutyleneterephthalate, polytrimethylene-terephthalate, ethylene-carbon monoxide copolymer, polyvinyl-diene fluorides, polyphenylene-sulfide, polypropyleneoxide, polyphenyloxide, polypropylene, functionalized polypropylene, polyethylene, ethylene-octene copolymer, ethylene-methyl acrylate, ethylene-butyl acrylate, polycarbonate, polysiloxane, functionalized polysiloxane, copolymeric ionomer, terpolymeric ionomer, polyetherester elastomer, polyesterester elastomer, polyetheramide elastomer, propylene-butadiene copolymer, modified copolymer of ethylene and propylene, styrenic copolymer (including styrenic block copolymer and randomly distributed styrenic copolymer, such as styrene-isobutylene copolymer and styrene-butadiene copolymer), partially or fully hydrogenated styrene-butadiene-styrene block copolymers such as styrene-(ethylene-propylene)-styrene or styrene-(ethylene-butylene)-styrene block copolymers, partially or fully hydrogenated styrene-butadiene-styrene block copolymers with functional group, polymers based on ethylene-propylene-(diene), polymers based on functionalized ethylene-propylene-(diene), dynamically vulcanized polypropylene/ethylene-propylene-diene-copolymer, thermoplastic vulcanizates based on ethylene-propylene-(diene), natural rubber, styrene-butadiene rubber, nitrile rubber, chloroprene rubber, fluorocarbon rubber, butyl rubber, acrylic rubber, silicone rubber, chlorosulfonated polyethylene, polyisobutylene, alfin rubber, polyester rubber, epichlorphydrin rubber, chlorinated isobutylene-isoprene rubber, nitrile-isobutylene rubber, 1,2-polybutadiene, 1,4-polybutadiene, cis-polyisoprene, trans-polyisoprene, and polybutylene-octene.

B. Ionomeric Materials

As mentioned above, ionomeric polymers often are found in covers and intermediate layers of golf balls. These ionomers also are well suited for blending into compositions within the scope of the present invention. Suitable ionomeric polymers (i.e., copolymer- or terpolymer-type ionomers) include α-olefin/unsaturated carboxylic acid copolymer-type ionomeric or terpolymer-type ionomeric resins that can be described as copolymer E/X/Y, where E represents ethylene, X represents a softening comonomer such as acrylate or methacrylate, and Y is acrylic or methacrylic acid. The acid moiety of Y is neutralized to form an ionomer by a cation such as lithium, sodium, potassium, magnesium, calcium, barium, lead, tin, zinc or aluminum. Also, a combination of such cations is used for the neutralization. Examples of suitable ionomeric resins include those marketed under the name SURLYN manufactured by E.I. DuPont de Nemours & Company of Wilmington, Del., and IOTEK manufactured by Exxon Mobil Corporation of Irving, Tex.

1. Copolymeric Ionomers

Copolymeric ionomers are obtained by neutralizing at least portion of carboxylic groups in a copolymer of an α-olefin and an α,β-unsaturated carboxylic acid having 3 to 8 carbon atoms, with a metal ion. Examples of suitable α-olefins include ethylene, propylene, 1-butene, and 1-hexene. Examples of suitable unsaturated carboxylic acids include acrylic, methacrylic, ethacrylic, alphachloroacrylic, crotonic, maleic, fumaric, and itaconic acid. Copolymeric ionomers include ionomers having varied acid contents and degrees of acid neutralization, neutralized by monovalent or bivalent cations discussed above.

2. Terpolymeric Ionomers

Terpolymeric ionomers are obtained by neutralizing at least portion of carboxylic groups in a terpolymer of an α-olefin, and an α,β-unsaturated carboxylic acid having 3 to 8 carbon atoms and an α,β-unsaturated carboxylate having 2 to 22 carbon atoms with metal ion. Examples of suitable α-olefins include ethylene, propylene, 1-butene, and 1-hexene. Examples of suitable unsaturated carboxylic acids include acrylic, methacrylic, ethacrylic, alphachloroacrylic, crotonic, maleic, fumaric, and itaconic acid. Terpolymeric ionomers include ionomers having varied acid contents and degrees of acid neutralization, neutralized by monovalent or bivalent cations discussed above.

The sound-altering material of the present invention may be selected from any number of materials, including those that have traditionally been used as weight fillers or as processing aids. The preferred materials include carbonates, sulfates, glass beads and metal stearates. In particular, carbonates sulfates, and hollow glass beads generally function to dampen the sound of a cover material. In contrast, metal stearates and solid glass beads tend to enhance the sound of the cover material. The preferred sound-altering materials include: zinc stearate supplied by AkroChem of Akron, Ohio; soda-lime glass spheres with a coupling agent, or borosilicate glass spheres with a coupling agent, supplied by Potter Industries, Inc. of Vally Forge, Pa.; and, Hubberbrite 3 (barium sulfate having a median particle size 3.2 microns) and Hubberbrite 10 (barium sulfate having a median particle size of 9.0 microns) supplied by JM Huber Corp., Edison, N.J. When glass beads are used as the sound-altering material, any conventional surface treatment may be added to the beads for promoting adhesion between the surface of the glass beads and the base material of the composition. Silanes are particularly useful in these surface treatements.

The base composition and sound-altering material can be mixed together to form the composition of the present invention, with or without melting them. Dry blending equipment, such as a tumbler mixer, V-blender, or ribbon blender, can be used to mix the compositions. The sound-altering material can be mixed together with the base composition or constituents of the base composition. The sound-altering material also can be added after addition of any of the additional materials discussed above. Materials can be added to the composition using a mill, internal mixer, extruder or combinations of these, with or without application of thermal energy to produce melting. In another method of manufacture of these compositions, the sound-altering material can be premixed with the base composition to produce a concentrate having a high concentration of sound-altering material. Then, this concentrate can be introduced into a composition of base composition urethane and additional materials using dry blending, melt mixing or molding. The additional materials also can be added to a color concentrate, which is then added to the composition to impart a white color to golf ball.

Conventionally, golf ball cover and intermediate layers are positioned over a core or other internal layer using one of three methods: casting, injection molding, or compression molding. Injection molding generally involves using a mold having one or more sets of two hemispherical mold sections that mate to form a spherical cavity during the molding process. The pairs of mold sections are configured to define a spherical cavity in their interior when mated. When used to mold an outer cover layer for a golf ball, the mold sections can be configured so that the inner surfaces that mate to form the spherical cavity include protrusions configured to form dimples on the outer surface of the molded cover layer. The mold sections are connected to openings, or gates, evenly distributed near or around the parting line, or point of intersection, of the mold sections through which the material to be molded flows into the cavity. The gates are connected to a runner and a sprue that serve to channel the molding material through the gates. When used to mold a layer onto an existing structure, such as a ball core, the mold includes a number of support pins disposed throughout the mold sections. The support pins are configured to be retractable, moving into and out of the cavity perpendicular to the spherical cavity surface. The support pins maintain the position of the core while the molten material flows through the gates into the cavity between the core and the mold sections. The mold itself may be a cold mold or a heated mold. In the case of a heated mold, thermal energy is applied to the material in the mold so that a chemical reaction may take place in the material.

In contrast to injection molding, which generally is used to prepare layers from thermoplastic materials, casting often is used to prepare layers from thermoset material (i.e., materials that cure irreversibly). In a casting process, the thermoset material is added directly to the mold sections immediately after it is created. Then, the material is allowed to partially cure to a gelatinous state, so that it will support the weight of a core. Once cured to this state, the core is positioned in one of the mold sections, and the two mold sections are then mated. The material then cures to completion, forming a layer around the core.

Compression molding of a ball layer typically requires the initial step of making half shells by injection molding the layer material into a cold injection mold. The half shells then are positioned in a compression mold around a ball core, whereupon heat and pressure are used to mold the half shells into a complete layer over the core. Compression molding also can be used as a curing step after injection molding. In such a process, an outer layer of thermally curable material is injection molded around a core in a cold mold. After the material solidifies, the ball is removed and placed into a mold, in which heat and pressure are applied to the ball to induce curing in the outer layer by compression molding.

A preferred method within the scope of the present invention involves injection molding a core, intermediate layer, or cover of the composition. In yet another preferred method, an intermediate layer or a cover of the composition can be prepared by injection molding half-shells. The half shells are then positioned around a core and compression molded. The heat and pressure melt the composition to seal the two half shells together to form a complete layer. Depending on the materials used for the base composition, additional thermal energy may be added to induce crosslinking.

In addition to the above, a preferred aspect of the method involves preparing the cover layer using injection molding and forming dimples on the surface of the cover layer. Alternately, the cover layer can be formed using injection molding without dimples, after which the cover layer is compression molded to form dimples.

EXAMPLES

A series of trials were conducted on golf balls prepared within the scope of the present invention, as well as on golf balls currently marketed for control, including the Taylor Made Distance Plus, the Maxfli Noodle, the Ben Hogan Apex Tour, and the Titleist Pro V1. Also tested for control was a golf ball designated ITS5–18A The balls prepared for the trials incorporated either sound-dampening or sound-enhancing materials Three types of sound-dampening and five types of sound-enhancing balls were prepared, respectively designated SD1 to SD 3 and SE1 to SE5. To prepare these balls, cover compositions were compounded using twin screw extrusion and then injection-molded around conventional cores or core/mantle sections to form covers of the golf balls.

The acoustic tests were performed by dropping the test golf balls from a height of eight feet onto a marble block. A microphone placed near the block recorded the sound produced by each golf ball as it struck the block. The sound waves were converted into electrical impulses, which then were converted into Pascals. This procedure measure the entire sound produced and does not distinguish between particular frequencies or mode. The measurement, in effect, primarily is a function of decibel level of the sound produced. A lower Pascal output effectuates a softer sound, which gives the perception of a softer feel. A greater Pascal output creates a louder sound, which gives the perception of a harder feel. Tests were run for each of the two types of sound-altering materials used. The balls were tested for cover hardness, ball compression, driver and 8-Iron speed and spin rate, and acoustic output. The compositions, physical properties and sound-related characteristics for the sound-dampening balls are shown below in Tables 1 and 2. The compositions, physical properties and sound-related characteristics for the sound-enhancing balls are shown below in Tables 3 and 4.

TABLE 1

| | SD1 | SD2 | SD3 | Distance Plus |
|---|---|---|---|---|
| Core Size | 1.58" | 1.58" | 1.58" | 1.58" |
| Core Compression | 75 | 75 | 75 | 75 |
| Core C.O.R | 0.803 | 0.803 | 0.803 | 0.803 |
| Mantle Hardness (Shore D) | n/a | n/a | n/a | n/a |
| Cover Hardness (Shore D)[1] | 62 | 62 | 63 | 61 |
| Type of Dampening Filler[2] | Huber-brite-3* | Huber-brite-3* | Huber-brite-12* | None (control) |
| Sound Dampening Filler Content in Cover Composition (pph) | 2 | 6 | 2 | n/a |
| PGA Ball Compression | 86 | 87 | 85 | 84 |
| USGA Driver Speed (mph) | 162.3 | 162.1 | 162 | 162 |
| USGA Driver Spin Rate (rpm) | 2940 | 2990 | 2890 | 2980 |
| 8-Iron Speed (mph) | 110.3 | 110.4 | 110.4 | 110.1 |
| 8-Iron Spin Rate (rpm) | 7110 | 7300 | 6770 | 6900 |
| Acoustic Output (Pascals) | .68 | .72 | .71 | .77 |

[1]Cover Composition: Ionomer Blend

[2]Sound Dampening Filler: same type of filler having a different average particle sizes: Hubberbrite 3 is barium sulfate having a median particle size 3.2 microns; Hubberbrite 10 is barium sulfate having a median particle size of 9.0 microns

*Barium Sulfate

The data in Table 1 illustrate that the addition of small amounts of barium sulfate to a cover composition will dampen the sound output of the golf ball, while retaining the mechanical properties of the original composition. As can be seen by the spin rates and speeds of the tested golf balls, similar measurements are seen with respect to the control ball (Distance Plus). This indicates that while the ball will have the flight characteristics of the Distance Plus, it will sound differently to the golfer when that golfer is putting or hitting short shots. A way to illustrate this effect more dramatically is to compare the combined feel (i.e., the sum of the cover hardness and ball compression values, which relates to perceived feel of the ball by a golfer) of the test balls and golf balls currently on the market.

TABLE 2

| | SD1 | SD2 | SD3 | Distance Plus | Noodle | Apex Tour | Pro V1 |
|---|---|---|---|---|---|---|---|
| Combined Feel | 148 | 149 | 148 | 145 | 135 | 136 | 132 |
| Acoustic Output (Pascals) | .68 | .72 | .71 | .77 | .71 | .71 | .69 |

The fact that the Maxfli Noodle, Ben Hogan Apex Tour and Titleist Pro V1 balls all are considered "soft balls" is validated by their relatively low values for combined feel and their soft sound when struck. On the other hand, the test balls within the scope of the present invention, SD1 to SD3, generally exhibit the higher combined feel values of a hard, distance ball, but they possess the low Pascal measurements generally associated with the marketed soft golf balls tested.

TABLE 3

| | SE1 | SE2 | SE3 | SE4 | SE5 | ITS5-18A |
|---|---|---|---|---|---|---|
| Core Size | 1.48" | 1.48" | 1.48" | 1.48" | 1.48" | 1.48" |
| Core Compression | 55 | 55 | 55 | 55 | 55 | 55 |
| Core C.O.R | 0.795 | 0.795 | 0.795 | 0.795 | 0.795 | 0.795 |
| Mantle Hardness (Shore D)[2] | 57 | 57 | 57 | 57 | 57 | 57 |
| Cover Hardness (Shore D)[1] | 51 | 49 | 50 | 49 | 50 | 51 |
| Type of Sound Enhancing Filler | Zinc Stearate | Zinc Stearate | 3000A CP-02** | 3000A CP-02** | 3000E CP-02** | None (control) |
| Sound Enhancing Filler[3] Content in Cover Composition (pph) | 3 | 5 | 3 | 5 | 5 | n/a |
| PGA Ball Compression | 70 | 71 | 70 | 71 | 70 | 70 |
| USGA Driver Speed (mph) | 159.3 | 159.3 | 159.7 | 159.1 | 159.2 | 159 |
| USGA Driver Spin Rate (rpm) | 3230 | 3300 | 3340 | 3370 | 3250 | 3300 |
| 8-Iron Speed (mph) | 109.6 | 109.7 | 109.6 | 109.9 | 109.6 | 109.2 |
| 8-Iron Spin Rate (rpm) | 7280 | 7510 | 7340 | 7540 | 7290 | 7440 |
| Acoustic Output (Pascals) | .67 | .64 | .65 | .65 | .64 | .61 |

[1]Cover Composition: Thermoplastic elastomer Blend
[2]Mantle Composition: Ionomer Blend
[3]Sound Enhancing Filler: Metal Stearate and inorganic filler having different surface treatment
** glass beads The data in Table 3 confirm that sound output may be increased by addition of small amounts of zinc stearate or glass beads, while again retaining the mechanical properties of the original composition. There are negligible speed and spin rate differences between the test balls and ITS5–18A, the control ball. This indicates that the golf ball will have the same flight characteristics of the control ball, while sounding harder while putting or making relatively short shots. Again, this effect is shown more dramatically by comparing the combined feel values of the test balls within the scope of the present invention to golf balls currently on the market.

TABLE 4

| | SE1 | SE2 | SE3 | SE4 | SE5 | ITS5-18A | Pro V1 | Apex Tour | Noodle |
|---|---|---|---|---|---|---|---|---|---|
| Combined Feel | 121 | 120 | 120 | 120 | 120 | 121 | 145 | 135 | 136 |
| Acoustic Output (Pascals) | .67 | .64 | .65 | .65 | .64 | .61 | .69 | .71 | .71 |

The data in Table 4 indicate that a ball having a very soft cover can be made to have the acoustic output of a similar ball on the market. In this case, the SE1, though having a much softer cover and lower combined feel than the PRO V1, has an acoustic output of 0.67 Pascals, which is very similar to the PRO V1 acoustical output of 0.69 Pascals. In general, balls SE1 to SE5 all exhibit far lower combined feel values than the marketed balls, but possess similar acoustic output. This results in the balls performing as softer, more controllable balls, while having the sound characteristics of harder balls.

These test results show that sound altering of a material composition is possible without sacrificing the mechanical characteristics of the composition. The sound output may selectively be increased or decreased depending on the needs of the golfer. Also, the addition of the sound-altering material causes no processing difficulties making it an economical method for producing golf balls having desirable properties.

Although the invention has been disclosed in detail with reference only to the preferred embodiments, those skilled in the art will appreciate that additional compositions amd methods can be made without departing from the scope of the invention. Accordingly, the invention is defined only by the claims set forth below.

We claim:

1. A golf ball having a core and one or more cover layers encasing the core, wherein at least one of the one or more cover layers comprises a composition, the composition comprising:

a base material; and solid glass beads whose outer surfaces have been treated to promote adhesion;

wherein the weight ratio in the composition of the base material to the solid glass beads is between 98:2 and about 95:5, and wherein the solid glass beads are configured to alter the sound produced when the golf ball is struck without substantially altering the golf ball's hardness and compression.

2. The golf ball of claim 1, wherein the solid glass beads are configured to increase the sound output produced when the golf ball is struck.

3. A method for preparing a golf ball layer, comprising the steps of:

preparing a composition comprising:

a base material, and solid glass beads whose outer surfaces have been treated to promote adhesion, wherein the weight ratio in the composition of the base material to the solid glass beads is between 98:2 and about 95:5; and forming the composition into a golf ball layer positioned around a golf ball core, wherein the solid glass beads are configured to alter the sound produced when the golf ball is struck, without substantially altering the golf ball's hardness and compression.

* * * * *